US007510415B2

(12) United States Patent
Wang

(10) Patent No.: US 7,510,415 B2
(45) Date of Patent: Mar. 31, 2009

(54) ELECTRICAL CARD CONNECTOR HAVING EJECTING MECHANISM

(75) Inventor: Zhi-Feng Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/070,366

(22) Filed: Feb. 15, 2008

(65) Prior Publication Data

US 2009/0011649 A1 Jan. 8, 2009

(30) Foreign Application Priority Data

Jul. 2, 2007 (TW) ..... 96210744 U

(51) Int. Cl.
*H01R 13/62* (2006.01)

(52) U.S. Cl. ..... 439/159; 439/630; 439/331

(58) Field of Classification Search ..... 439/159, 439/157, 630–632, 331
See application file for complete search history.

(56) References Cited

U.S. PATENT DOCUMENTS 5,368,498 A * 11/1994 Matsuoka et al. ..... 439/331
5,507,658 A * 4/1996 Ho ..... 439/159
6,155,853 A * 12/2000 Kajiura ..... 439/159
6,231,364 B1 * 5/2001 Liu ..... 439/326
6,962,500 B1 11/2005 Chen
7,427,206 B2 * 9/2008 Takei et al. ..... 439/159

FOREIGN PATENT DOCUMENTS

TW 314665 9/1997
TW 325154 1/1998

* cited by examiner

*Primary Examiner*—Truc T Nguyen
(74) *Attorney, Agent, or Firm*—Wei Te Chung

(57) ABSTRACT

An electrical card connector (100) for receiving a card comprises an insulating housing (1), a shield (2) having an end mounted on the insulating housing and another end defining an inserting opening for the card inserting, and an ejector (4) assembled on a lateral side of the shield. The ejector comprises a ejecting mechanism for ejecting the card, and a pushing mechanism connecting with the ejecting mechanism. The pushing mechanism comprises a plastic pushing bar (43), a base (42) mating with the pushing bar, a slider (44) received in the pushing bar and the base, a spring member (46) mounted on the pushing bar, and a metal piece (430) assembled on the pushing bar.

7 Claims, 4 Drawing Sheets

ELECTRICAL CARD CONNECTOR HAVING EJECTING MECHANISM

BACKGROUND OF THE INVENTION

1. Field of the Invention

The present invention generally relates to an electrical card connector, and more particularly to an electrical card connector having an ejecting mechanism.

2. Description of Prior Art

Modern times, the PC card is always used as an external equipment for increase the storage of the electrical consumer products, like Mobile phone, Digital camera, etc. The electrical card connector is used for electrically connecting the PC card and the electrical consumer products. An ejecting mechanism is used on the card connector for ejecting the card from the card connector.

TW. Pat. No. 325154 and TW. Pat. No. 314665 disclose a kind of nonage ejecting mechanism. This kind of ejecting mechanism always comprises a plastic pushing bar for pushing the ejecting mechanism to ejecting the card. However, the plastic pushing bar is easily broken cause of its weak strength. Otherwise, if we change the material of the pushing bar into the metal, the weight and the cost would be increased.

Hence, it is desirable to have an improved card connector to overcome the above-mentioned disadvantages of the prior art.

BRIEF SUMMARY OF THE INVENTION

Accordingly, the object of the present invention is to provide an electrical card connector having an ejecting mechanism, which has a tougher pushing bar.

In order to achieve the above-mentioned object, an electrical card connector for receiving a card comprises an insulating housing, a shield having an end mounted on the insulating housing and another end defining an inserting opening for the card inserting, and an ejector assembled on a lateral side of the shield. The ejector comprises a ejecting mechanism for ejecting the card, and a pushing mechanism connecting with the ejecting mechanism. The pushing mechanism comprises a plastic pushing bar, a base mating with the pushing bar, a slider received in the pushing bar and the base, a spring member mounted on the pushing bar, and a metal piece assembled on the pushing bar.

Other objects, advantages and novel features of the invention will become more apparent from the following detailed description of the present embodiment when taken in conjunction with the accompanying drawings.

DETAILED DESCRIPTION OF THE INVENTION

Figure 1:
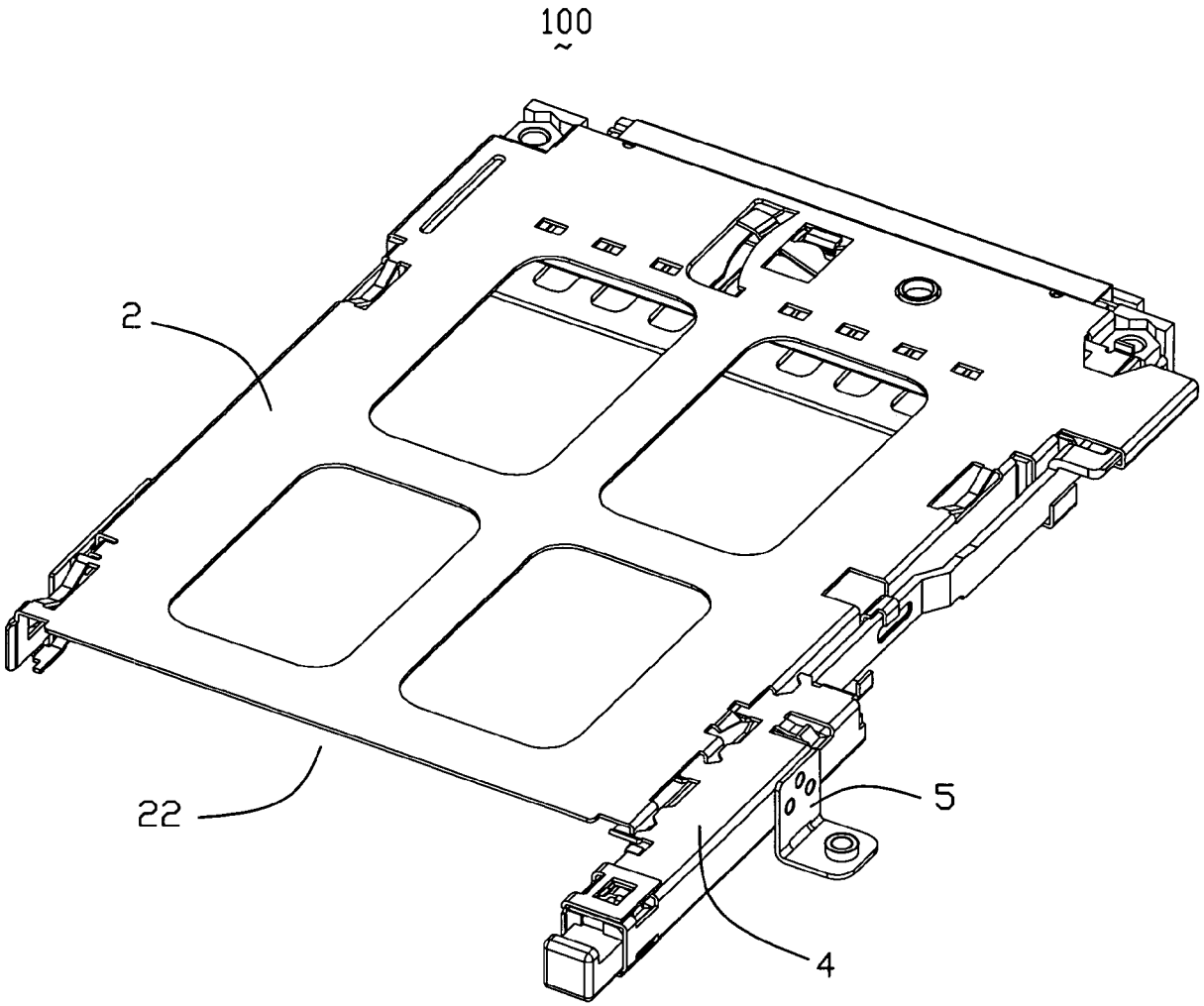
FIG. 1 is a perspective view of an electrical card connector in accordance with the present invention.

Reference will now be made to the drawing figures to describe the present invention in detail.

Referring to FIG. 1 to FIG. 5, an electrical connector 100 comprises an insulating housing 1, a shield plate 2 cover the insulating housing 1, a plurality of terminals 3 received in the insulating housing 1 and an ejector 4 assembled on a lateral side of the shield plate 2, a positioning member 5 mounted on opposite lateral sides of the shield plate 2 for positioning the electrical connector 100, and a grounding plate 6 sandwiched by the insulating housing 1 and the shield plate 2.

The insulative housing 1 comprises a base portion 10, a pair of lateral arms 11 extending from the opposite sides of the base portion 10, and a retaining portion 12 at the front end of the both lateral arms 11. The base portion 12 defines a plurality of passageways for receiving the terminals, and forms a plurality of blocks at the top surface thereof. Each lateral arm 11 defines a guiding channel 110 for guiding the card inserting, and forms a plurality of protrusions 111 at the outer surface thereof.

The shield plate 2 comprises a main body 20, a pair of lateral portion 21 extending downwardly from opposite edges of the main body 20. The main body 20 and the lateral portion 21 together defines a receiving space for receiving the card. The main body 20 provides a card inserting opening 22 at a end opposite to the insulating housing 1. A plurality of retaining cutouts 24 are defined at the lateral portions to locking with corresponding protrusions 111.

The terminals 3 are received in the passageways of the insulating housing 1 with one end of each projecting the receiving space and the other end projecting beyond the insulating housing to mating with a locating board 32 and retaining by a circuit board 32. A plurality of vertical channels 321 are defined on outer surface of the circuit board 32 in a card inserting direction.

The grounding plate 6 comprises a plurality of grounding pins 61 and a pair of retaining holes 63 at opposite ends thereof. The grounding pins 61 is received in the corresponding vertical channels 321 to shield the terminals 3. The retaining holes 63 lock with the blocks 112 of the insulating housing 1 to position the grounding plate 6 at the insulating housing 1.

Figure 2:
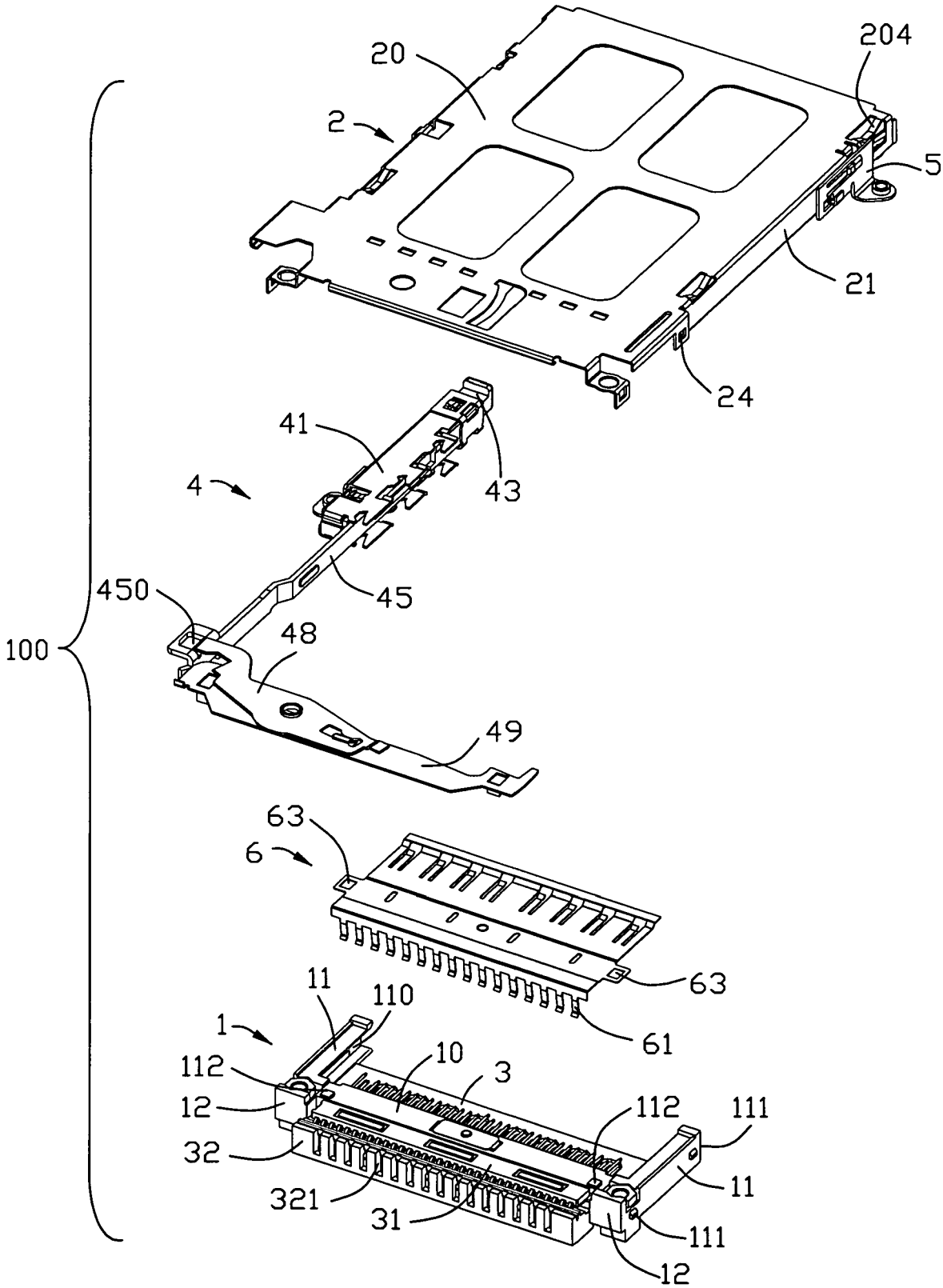
FIG. 2 is an exploded, perspective view of the card connector shown in FIG. 1.
Figure 3:
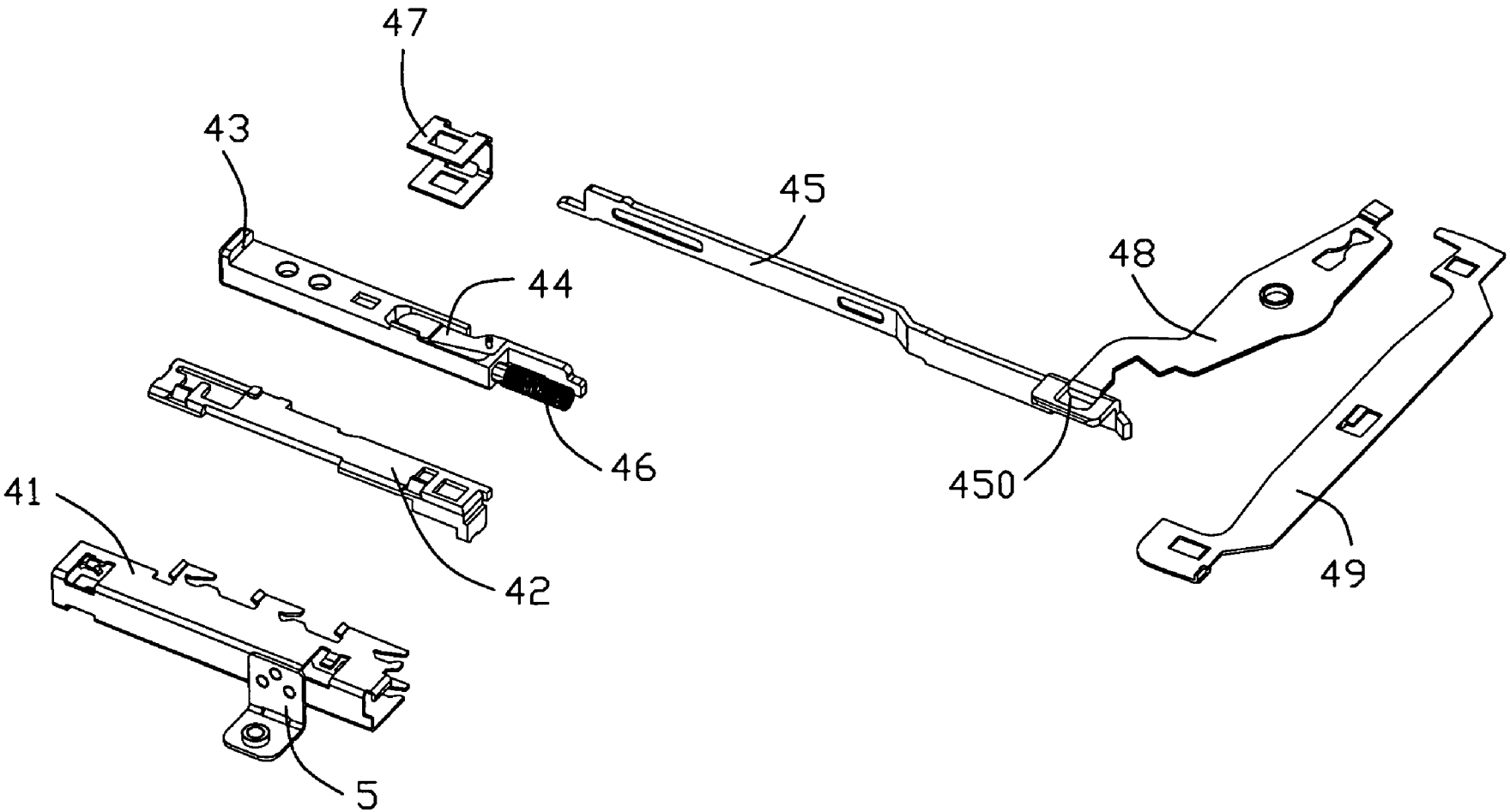
FIG. 3 is an exploded, perspective view of an ejecting mechanism of the card connector.
Figure 4:
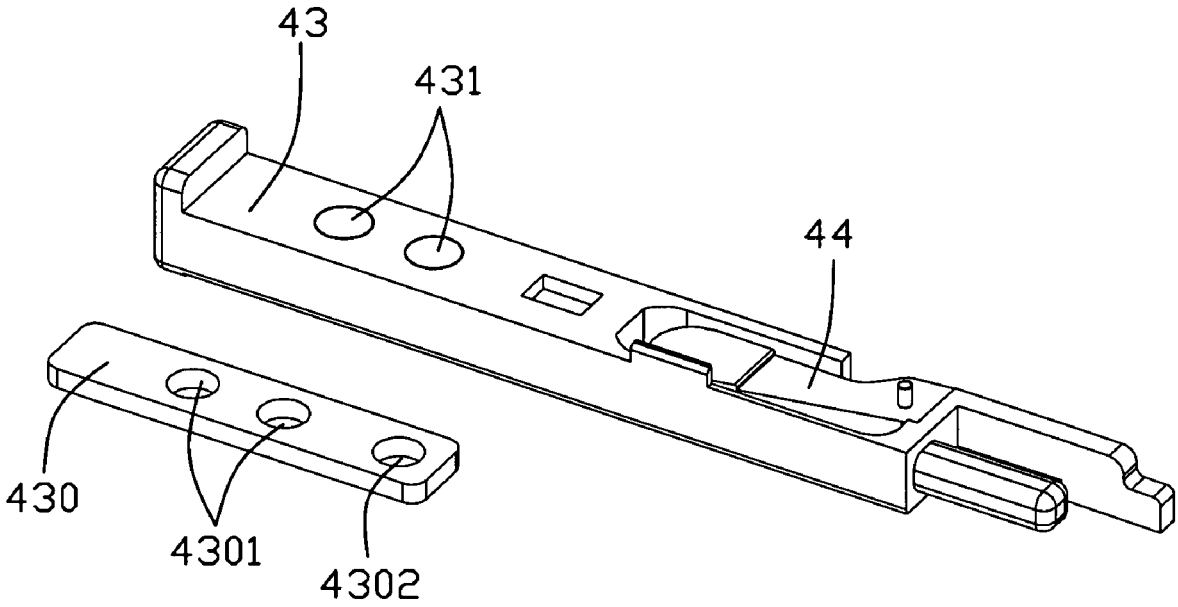
FIG. 4 is an exploded, perspective view of a pushing bar of the card connector.

Referring to FIGS. 2-4, the ejector 4 comprises a pushing mechanism and an ejecting mechanism. The pushing mechanism comprises a metal frame 41, a base 42 having a heart-shaped track (not shown) therein, a plastic pushing bar partially received in the metal frame 41, a pivotable slider 44 having a guiding pin thereof cooperated with the aforementioned heart-shaped track of the base 42 as a position-decision structure to decide the pushing bar is either in a front position or a rear position relative to the metal frame 41, a spring member 46, a connecting pole 45 and a retaining member 47. The ejecting mechanism comprises a lever portion 48 and a ejecting plate 49. The way of the ejector 4 working and assembling to the shield plate 2 has been disclosed by prior art. The ejector 4 further comprises a metal piece 430 insert-molded in the pushing bar 43. The metal piece 430 comprises a plurality of positioning holes 4301 and a retention hole 4302. The pushing bar 43 defines a plurality of holes 431 corresponding to the positioning holes 4301 to positioning the position of the metal piece 430 in the pushing bar 43. The retention hole 4302 is used for increasing the retention force between the pushing bar 43 and the metal piece 430. The strength of the pushing bar 43 is increased because of the exist of the insert-molded metal piece 430.

In another embodiments, the metal piece 430 can be assembled on the pushing bar 43 by another ways, such as the pushing bar 43 defines a plurality of blocks, and the metal piece 430 forms a plurality of protrusions to locking with the blocks.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector for receiving a card, comprising:

an insulative housing;

a shield comprising an end mounted on the insulative housing and another end defining an inserting opening for the card inserting; and an ejector assembled on a lateral side of the shield, comprising:

an ejecting mechanism for ejecting the card; and a pushing mechanism connecting with the ejecting mechanism, comprising a plastic pushing bar, a base mating with the pushing bar, a slider movably received in the pushing bar and the base, a spring member mounted on the pushing bar, and a metal piece assembled on the pushing bar;

wherein the metal piece comprises a plurality of positioning holes, the pushing bar defines a plurality of holes corresponding to the positioning holes to positioning the metal piece on the pushing bar;

wherein the metal piece defines a retention hole to increase the retention force between the pushing bar and the metal piece.

2. The electrical card connector as claimed in claim 1, wherein the metal piece is insert-molded in the pushing bar.

3. An electrical card connector an electronic card, comprising:

an insulative housing;

a metallic shell attached to the housing and cooperating with the housing to define a card receiving cavity; and an ejector associated with the shell and including an ejection section extending into the card receiving cavity for ejecting said card, and a pushing section linked to the ejection section;

said pushing section including an insulative pushing bar with a metallic frame enclosing upper, lower and outer sides of said pushing bar, said pushing bar moveable with regard to the metallic frame along a front-to-back direction; wherein said insulative pushing bar includes a front region where a compression spring is equipped with, a middle region where a position-decision structure is applied to, and a rear region where a metallic reinforcement piece is embedded in;

a metal piece assembled on the pushing bar;

wherein the metal piece comprises a plurality of positioning holes, the pushing bar defines a plurality of holes corresponding to the positioning holes to positioning the metal piece on the pushing bar;

wherein the metal piece defines a retention hole to increase the retention force between the pushing bar and the metal piece.

4. The electrical card connector as claimed in claim 3, wherein said position-decision structure is a pivotable slider.

5. The electrical card connector as claimed in claim 3, wherein the insulative pushing bar is connected to a metallic connection pole so as to have said connection pole commonly move along with the push bar during operation.

6. The electrical card connector as claimed in claim 5, wherein the ejection section includes a lever portion engaged with the connection pole, and an ejection plate pivotally linked to the lever portion so as to have the ejection plate and the connection pole moved in opposite directions with each other during said operation.

7. The electrical card connector as claimed in claim 5, wherein said connection pole is essentially a metal plate lying on a plane, and said reinforcement piece is another metal plate lying on another plane perpendicular to said plane.

* * * * *